United States Patent [19]

Joseph

[11] Patent Number: 4,667,957

[45] Date of Patent: May 26, 1987

[54] BASKETBALL RETRIEVAL APPARATUS

[76] Inventor: John Joseph, 475 N. Third St. Upper Sandusky, Ohio 43351

[21] Appl. No.: 654,407

[22] Filed: Sep. 26, 1984

Related U.S. Application Data

[63] Continuation of Ser. No. 615,813, May 31, 1984, abandoned.

[51] Int. Cl.[4] ..... A63B 69/00

[52] U.S. Cl. ..... 273/1.5 A; 273/397; 198/368; 209/657

[58] Field of Search ..... 273/1.5 A, 1.5 R, 396, 273/394, 397; 198/362, 366–369; 209/655–657

[56] References Cited

U.S. PATENT DOCUMENTS

| | | | |
|---|---|---|---|
| 1,571,298 | 2/1926 | Pavloff | 56/329 |
| 2,838,308 | 6/1958 | Polite | 273/396 X |
| 3,233,896 | 2/1966 | King | 273/1.5 A |
| 3,471,150 | 10/1969 | Kaerwer | 273/1.5 A |
| 3,776,550 | 12/1973 | McNabb | 273/1.5 A |
| 3,814,421 | 6/1974 | Spier, Jr. | 273/1.5 A |
| 3,901,506 | 8/1975 | Caveney | 273/1.5 A |
| 3,917,263 | 11/1975 | Wiley | 273/1.5 A |

FOREIGN PATENT DOCUMENTS

| | | | |
|---|---|---|---|
| 2626022 | 12/1977 | Fed. Rep. of Germany | 273/396 |

*Primary Examiner*—Paul E. Shapiro
*Attorney, Agent, or Firm*—George C. Atwell

[57] ABSTRACT

A portable apparatus having a funnel-like ball collector for disposition generally circumjacent a mounted basketball hoop on a basketball court and including a diverter mechanism beneath the collector for receiving successive basketballs from the collector and diverting them outwardly to one or more player positions on the court to enable such players to continually practice throwing the balls to the hoop without having to change position.

13 Claims, 6 Drawing Figures

BASKETBALL RETRIEVAL APPARATUS

CROSS REFERENCE TO RELATED APPLICATION

This application is a continuation of application Ser. No. 06/615,813 filed May 31, 1984 now abandoned.

BACKGROUND OF THE INVENTION

This invention pertains generally to basketball retrieval and return apparatus and, more specifically, relates to central structure for such apparatus which controls the direction of ball return.

Various structures and devices have been provided in the prior art for the purpose of retrieving basketballs from the area of the hoop and backboard on a conventional basketball court and returning them to the general position of a player and thereby enable successive shooting practice from a predetermined position without the need for the player to retrieve the ball. Examples of various forms of apparatus for this purpose will be found in U.S. Pat. Nos. 2,838,308; 3,776,550; 3,901,506; and 3,917,263. Such prior art devices as disclosed in the foregoing patents either are intended to return retrieved balls generally onto the court without regard to a specific pretargeted player position or, as in the aforementioned U.S. Pat. No. 3,776,550, to one single definite player positioned on the court.

SUMMARY OF THE INVENTION

The present invention comprehends the provision of a basketball diverter mechanism for use in a basketball retrieval and return apparatus, which is capable of directing retrieved balls to one or more specific player positions on a basketball court or in a successive alternating pattern to more than one position on the basketball court. The invention is intended to add to any basketball retrieval and return apparatus certain significant versatility of use not heretofore available in such apparatus.

The ball diverter mechanism disclosed herein is designed and adapted to receive downwardly-falling balls, successively, and direct them to appropriate ramps on which the balls will roll to pretermined positions on the playing court or other ball handling equipment such as the ball return system disclosed in the aforementioned U.S. Pat. No. 3,776,550.

In its presently preferred form, the basketball diverter mechanism of the present invention has three side openings for directing balls in as many directions, and includes repositionable ball guiding components which may be utilized to guide successive balls solely through any one of the side openings or in an alternating pattern through different side openings to different player positions on the court.

More specifically, the basketball diverter mechanism of the present invention has a rigid box-like structure with a lower end floor plate and an upwardly-facing ring-like opening intended to be placed in communication to receive balls guided therein by a funnel-like collector suspended thereabove which may constitute a large basket-shaped receptacle formed from netting similar to that disclosed in said U.S. Pat. No. 3,776,550. The diverter mechanism of the present invention is intended to be placed directly beneath such basket-like receptacle and supported upwardly three or more feet from the court floor, so that appropriate ramp means, not entirely dissimilar to that generally shown in said U.S. Pat. No. 3,917,263, can be affixed to receive balls from each of the side openings of the diverter mechanism and allow the balls to roll outwardly to a predetermined player position.

A specific feature of the diverter mechanism of the present invention is that the repositionable guide means in one orientation is actuated by a ball moving through the box-like structure and thereby caused to reposition whereby the next ball exits through a different side opening and also gets to reposition the guide means to effect the direction of exit of the next ball, etc.

Other features and characteristics of the present invention will be apparent from the ensuing description of the accompanying drawings and the detailed description of the presently preferred embodiment of the invention shown in the drawings.

DETAILED DESCRIPTION OF THE PREFERRED EMBODIMENT

Figure 1:
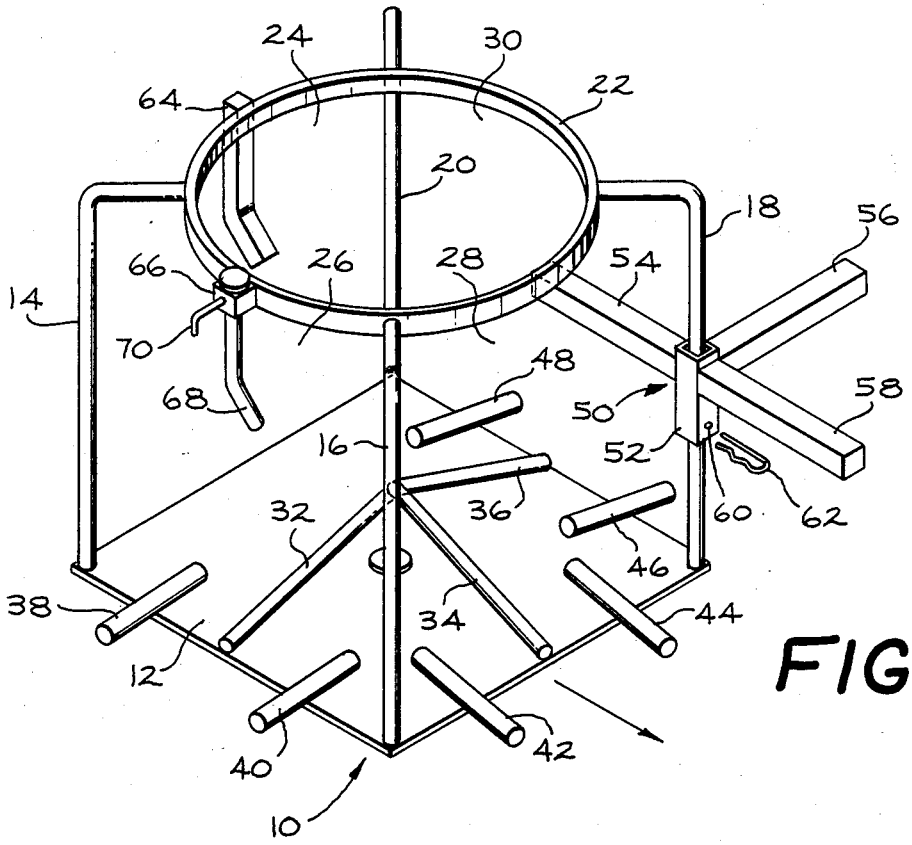
FIG. 1 is an illustration of a presently preferred form of a basketball diverter mechanism in accordance with the present invention.

FIG. 1 illustrates a basketball diverter mechanism 10 having a solid floor or rigid plate 12, from the corners of which are upwardly projecting rigid corner posts 14, 16, 18, and 20. Each of the corner posts extends inwardly at its upper end to support, in unison, a rigid circular ring 22 which circumscribes and defines an upwardly-facing opening 24. The floor 12, the ring 22, and the four corner posts 14–20 form an overall box-like structure and the open area between adjacent corner posts defines side openings identified, respectively, as side opening 26, 28, and 30.

The ball guide means of the ball diverter mechanism 10 includes fixed rods 32, 34, and 36 which are preferably welded to.the floor plate 12 to form an upward central projection at their point of jointure whereby a basketball falling downwardly through the opening 24 into the mechanism 10 will be disposed to roll away from center over the floor plate 12 in the direction of the path of least resistance. Also fixedly mounted on the floor plate 12 are guide bars 38, 40, 42, 44, 46, and 48, which project outwardly in spaced-apart pairs from the side openings 26, 28, and 30. These guide bars constitute integral ramps for guiding balls from the respective openings and outwardly from the mechanism to substantially long guide ramps (not shown) which would be utilized to carry an exiting ball to a player position on the court floor.

FIG. 1 also shows a rotable member 50 mounted on corner post 18 which is also part of the guide means of the mechanism 10. The member 50 is a T-shaped member comprising a base socket 52 having rigid integral legs 54, 56, and 58 projecting therefrom. The socket 50 has a small aperture 60 provided in the lower portion thereof to accommodate a fastening pin 62 for a purpose which will be hereafter described.

Figure 3:
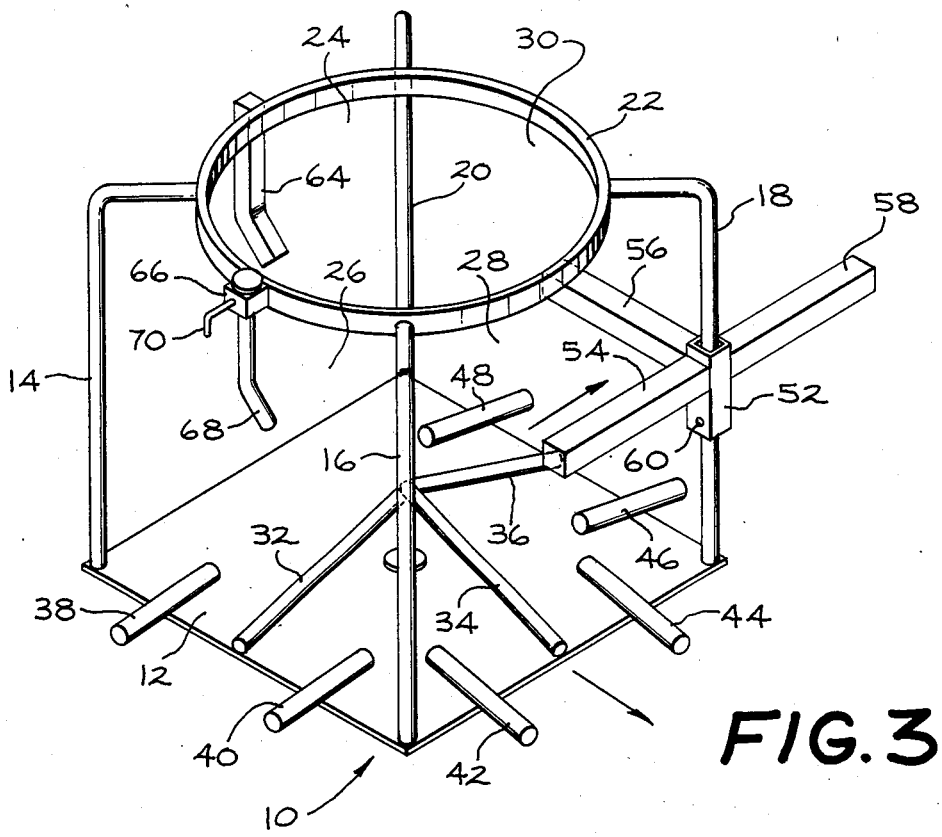

FIG. 1 also illustrates that the ring 22 has an integral downwardly-inwardly projecting stop bar 64 disposed between corner posts 14 and 20 to permanently prevent balls from exiting between the corner posts 14 and 20. Further, the ring 22 is provided, at an intermediate point between the legs 14 and 16, with an integral socket 66 in which is slidably secured a movable stop bar 68. The stop bar 68 is adapted to be movable relative to the ring 22 and locked in one of two positions. The first is its extended position as shown in FIG. 1 and the second is its retracted position as shown in FIG. 3 wherein the bar 68 is locked in a retracted position by means of a set screw 70.

Having heretofore described, with primary reference to FIG. 1, all of the structural components of the ball diverting mechanism 10, the operation of the mechanism as part of a basketball retrieval and return apparatus can now be described. Various means can be utilized for mounting the mechanism 10 in operative position centrally as part of such an apparatus, and one such means can be a floor-mounted support post (not shown) which would be welded at its upper end to the center of the floor plate 12 on the underside thereof. The mechanism 10 would be located approximately three feet or more from the floor and have its ring 22 joined in communication with the lower end of a large basket-like receptacle oriented to receive basketballs moving downwardly through the basketball hoop or glancing off the backboard. Such balls would be directed downwardly successively through the ring 22 and into the mechanism 10. A ball falling downwardly into the mechanism 10, as shown in FIG. 1, will exit through the side opening 28 and between corner posts 16 and 18, in the direction of the arrow shown in FIG. 1. It should be noted that the mechanism 10 would be mounted with the side opposite the opening 28 oriented generally toward the backboard on the playing court and that bar 64 serves to prevent the ball within the mechanism from rolling rearwardly. Moreover, the bar 68 prevents the ball from moving through the opening 26 while the arm 54, in its position shown in FIG. 1, prevents the ball from moving through the opening 30. Thus, the ball would be diverted outwardly in the direction of the arrow through opening 28.

Figure 2:
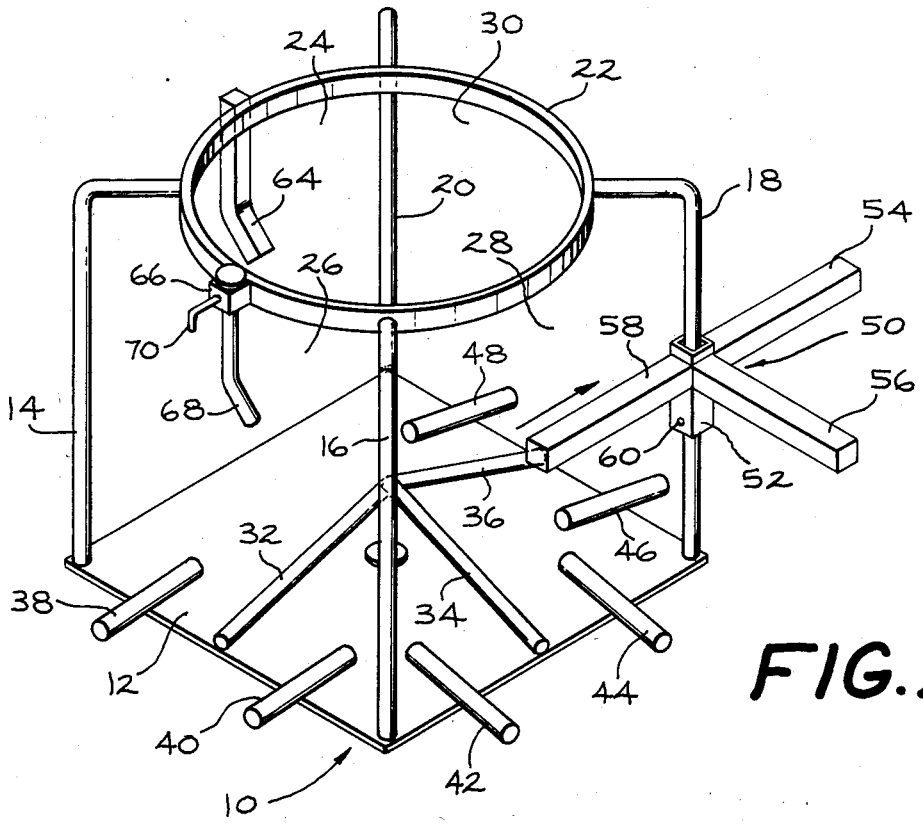
FIGS. 2, 3, and 4 illustrate the same basketball diverter mechanism shown in FIG. 1 but with certain movable components of a ball guide means being oriented in respectively different positions to effect the direction of balls exiting from the mechanism, as will be hereafter described in greater detail.

Referring now to FIG. 2 it will be seen that a ball received through the ring 22 would be blocked from moving through any of the side openings except side opening 30, because the member 50 has been manually rotated, as compared to FIG. 1, to a disposition whereby arm 54 now extends across opening 28 but no longer blocks opening 30 as it did in FIG. 1.

It is important with respect to the operation of the diverter mechanism 10 that the rotatable member 50 be locked in the positions shown, respectively, in FIGS. 1 and 2, so the member 50 cannot be rotated by the force of the ball against its arm 54. Locking of the member 50 against rotation is accomplished by insertion of a pin 62 through aperture 60, as shown in FIG. 1. It should be further noted that the pin 60 is not utilized when it is desired to have successive balls exit from the diverter mechanism 10 in an alternating fashion, as will be understood from the ensuing description of FIG. 3.

The disposition of the guide means of the diverter mechanism 10, when it is desired to have successive balls leave the diverter mechanism in alternating direction, is shown in FIG. 3. The rotatable member 50 is disposed whereby adjacent arms 54 and 56 are respectively closing off openings 28 and 30. The member 50 is free to rotate 90° in response to the impingement against one of the arms of a ball moving through the diverter mechanism 10. Means for limiting rotation of the member 50 is provided, which co-acts between the support post 18 and the socket 52 of the member 50 as hereafter described. When a ball drops into the diverter mechanism 10, as shown in FIG. 3, impingement of the ball against the arm 54 will cause the member 50 to rotate (counterclockwise as viewed from above) whereby the ball will move outwardly through the opening 28, and such rotation of the member 50 will cause the arm 56 to swing into position across the opening 28 and also simultaneously cause the arm 58 to move into position across the opening 30. Thereafter, when the next ball comes into the diverter mechanism 10, the ball's impingement against the arm 58 will cause a rotative movement of the member 50 (clockwise as viewed from above) and allow the ball to move outwardly through the opening 30 while at the same time returning the rotatable member 50 to the disposition shown in FIG. 3. The aforedescribed alternating action will occur continuously during use of the diverter mechanism 10 until such time as the member 50 is selectively locked in one of the positions shown in FIGS. 1, 2, or 4, by means of the pin 62.

Figure 4:
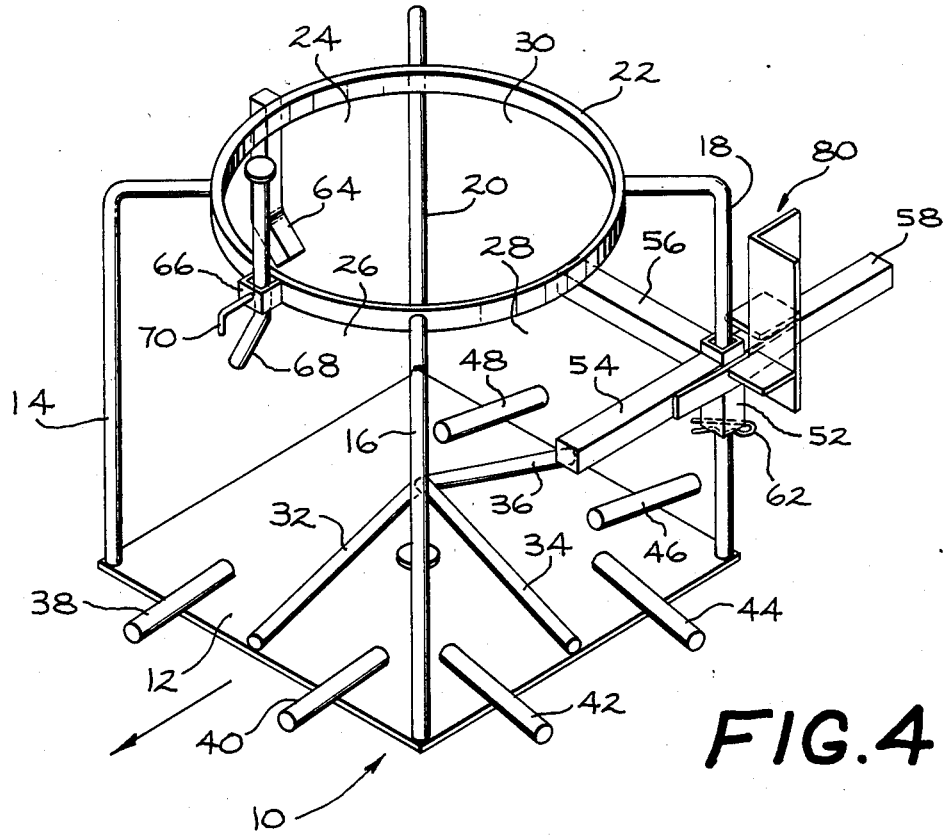

FIG. 4 shows the disposition of the guide means to enable exiting of balls from the diverter mechanism 10 in the single direction shown by the arrow in the figure. Here it should be noted that the movable stop bar 68 is locked into its retracted position to enable exiting balls to move through the opening 26 between the corner posts 14 and 16, and that the rotatable member 50 is locked in the disposition shown whereby its arms 54 and 56, respectively, block the openings 28 and 30. FIG. 4 also illustrates a special structure 80, not shown in FIGS. 1–3, for controlling the member 50.

Figure 5:
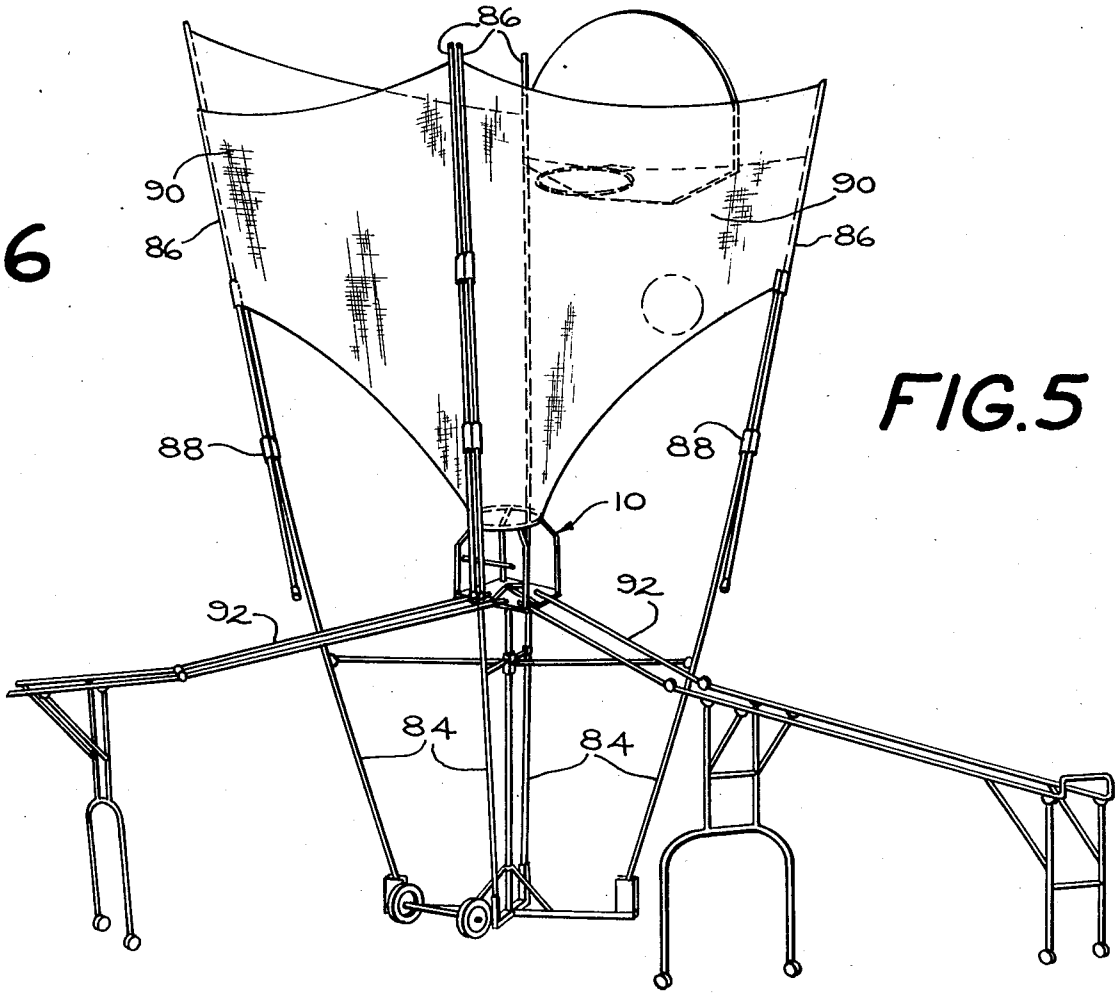
FIG. 5 illustrates a preferred form of basketball retrieval and return apparatus which utilizes the diverter mechanism shown in FIGS. 1–4.
Figure 6:
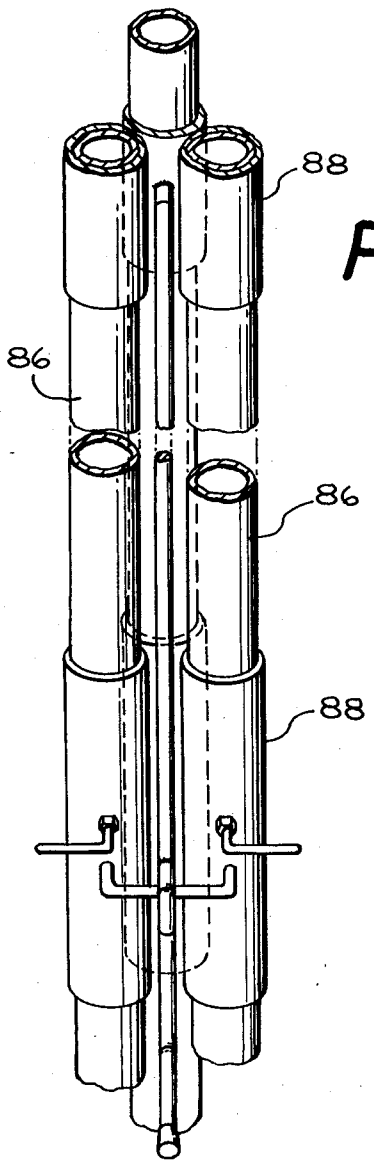
FIG. 6 is an enlarged portion of structure first shown in FIG. 5.

FIG. 5 illustrates the basketball retrieval and return apparatus, consistent with the present invention, which utilizes the diverter mechanism 10. The entire apparatus shown in FIG. 5 is designed to be retractable and collapsible whereby it can be easily wheeled from the basketball floor by one man and then quickly replaced in position and re-erected as needed. The apparatus shown in FIG. 5 comprises a floor mounted base assembly 82 having, projecting upwardly therefrom, legs 84 forming a quadrant arrangement with each other. From each leg 84 at the upper end thereof, is a pair of arms denoted by the numeral 86 which are slidably secured to the legs 84 by a socket arrangement 88 shown in more detail in FIG. 6. Netting panels 90 are suspended between arms 86 whereby their upper edges are above the level of the basketball hoop. The netting panels cooperatively act to create a funnel-like ball collector which diverts balls downwardly to the diverter 10 for distribution therefrom outwardly, as desired, on ramps 92.

I claim:

1. A basketball diverter mechanism for use in combination with a basketball retrieval and return apparatus on a basketball court comprising:

a rigid box-like structure having a floor and an oppositely-disposed upwardly-facing ball-entrance opening for receiving successive basketballs directed thereto by a communicating chute;

a plurality of side openings oriented to enable basketballs received within the structure to exit therefrom;

selectively-repositionable ball guide means adapted to be manually positioned to guide basketballs successively outwardly from the interior of the structure and through a first of the side openings exclusive of the other side openings; and the guide means being further adapted to be repositioned to guide balls through a second of the side openings exclusive of the first and other side openings.

2. The basketball diverter mechanism of claim 1 wherein the ball guide means is adapted to be further repositioned to direct balls alternately through two of the side openings.

3. The basketball diverter mechanism of claim 1 wherein the ball guide means includes a plurality of guiding components fixed to the floor of the box-like structure.

4. The basketball diverter mechanism of claim 3 wherein the ball guide means includes a manually-rotatable member adapted to be rotatively repositioned to cause balls received within the box-like structure to exit through predetermined side openings.

5. The basketball diverter mechanism of claim 4 further including means for locking the rotatable guide member in a preselected position.

6. The basketball diverter mechanism of claim 3 further including a rigid finger-like stop bar movably secured on the periphery of one of the side openings and adapted to be manually moved between first and second positions whereby in the first position it projects across the opening to prevent balls from exiting therethrough and in the second position it is retracted from the opening to enable balls to exit therethrough.

7. Basketball retrieval and return apparatus comprising a portable support frame, a funnel-like collector supported on the frame to receive balls thrown toward a backboard mounted hoop, a diverter mechanism mounted below the collector to receive balls directed thereto by the collector, the diverter mechanism having a plurality of side openings oriented to enable balls to exit therefrom in different generally lateral directions, selectively-repositionable ball guide means adapted to be manually positioned to guide balls successively outwardly from the interior of the diverter mechanism through a first of the side openings exclusive of the other side openings, and a guide means being further adapted to be repositioned to guide balls through a second of the side openings exclusive of the first and other side openings, and ramp means disposed to receive balls from the diverter mechanism and direct them outwardly away from the diverter mechanism to a predetermined player position.

8. The apparatus of claim 7 wherein the funnel-like collector is disposed whereby its uppermost edge is maintained no lower than the height of the hoop.

9. The apparatus of claim 7 wherein the upper edge of the collector is maintained at a level above the height of the hoop.

10. Basketball retrieval apparatus comprising a portable support frame, a funnel-like collector supported on the frame to receive balls thrown toward a backboard mounted hoop, a diverter mechanism mounted below the collector to receive balls directed thereto by the collector and divert the balls outwardly onto the court, the collector comprising a plurality of vertically-extending panels adapted to be seperately vertically adjusted whereby the height of each panel can be selectively determined in accordance with the height and throwing characteristics of a player utilizing the apparatus.

11. The apparatus of claim 10 wherein each of the panels is supported by spaced-apart vertically-extending support arms.

12. The apparatus of claim 11 wherein each of the panels is comprised of flexible netting material stretched between and fastened to the spaced-apart support arms.

13. Basketball retrieval apparatus comprising a portable support frame, a collector supported on the frame to receive balls thrown toward a backboard mounted hoop, a diverter positioned beneath the collector to receive balls directed thereto by the collector and divert the balls outwardly onto a court, the collector comprising a plurality of vertically extending panels and means for independently vertically adjusting the height of each panel.

* * * * *